United States Patent [19]

Dassance et al.

[11] Patent Number: 4,959,988

[45] Date of Patent: Oct. 2, 1990

[54] APPLICATOR DIE

[75] Inventors: Donald A. Dassance, Cadillac; Richard E. Feldborg, Grosse Pointe, both of Mich.

[73] Assignee: ACU-Crimp, Inc., Mesick, Mich.

[21] Appl. No.: 418,501

[22] Filed: Oct. 10, 1989

[51] Int. Cl.[5] ..... H01R 43/04

[52] U.S. Cl. ..... 72/421; 29/566.2; 29/753

[58] Field of Search ..... 29/566.2, 753; 72/421; 226/68, 151, 160, 167

[56] References Cited

U.S. PATENT DOCUMENTS

| | | | |
|---|---|---|---|
| 3,004,581 | 10/1961 | Krol et al. | 29/566.2 |
| 3,343,398 | 9/1967 | Kerns | 72/413 |
| 3,867,754 | 2/1975 | Koch et al. | 29/566.2 |
| 3,969,806 | 7/1976 | McCaughey | 29/753 |
| 4,306,443 | 12/1981 | Matsutani | 72/434 |
| 4,307,504 | 12/1981 | Davis et al. | 29/566.3 |
| 4,398,573 | 8/1983 | Kreid | 140/105 |

OTHER PUBLICATIONS

Diamond Die and Mold Company Crimping Apparatus (3 shts.) Drawings.
Artos Crimping Apparatus Drawing (1 sheet).
Amp, Inc. Crimping Apparatus Drawing (1 sheet).
Toyojamco Crimping Apparatus Drawing (2 sheets).
Packard Crimping Apparatus Drawing (1 sheet).

*Primary Examiner*—Lowell A. Larson
*Attorney, Agent, or Firm*—Krass & Young

[57] ABSTRACT

An applicator die for use with a crimping machine of the type in which a supply of terminals are fed in the form of a terminal strip comprising a carrier band and a plurality of terminals respectively secured at one end thereof to successive points along the band, individual leads are fed to the machine and the machine functions to crimpingly apply a terminal to an end of each lead and sever the terminal from the carrier band. The applicator die includes a housing defining a generally vertical slideway, a slide mounted for reciprocal, vertical movement in the slideway to actuate the crimping and severing dies, a cam pin carried by the slide, a cam plate pivotally secured to the housing and defining a cam slot receiving the cam pin, a pair of upper and lower horizontal guide plates defining the terminal strip feed path, a hanger structure secured to the lower end of the cam plate and extending downwardly along a side edge of the horizontal guide plates to a location below the guide plates, and a feed finger pivotally mounted on the lower end of the hanger structure underneath the guide plates and including a pointed end extending upwardly through a slot in the lower guide plate for engagement with drive holes in the terminal strip.

18 Claims, 5 Drawing Sheets

APPLICATOR DIE

BACKGROUND OF THE INVENTION

This invention relates to applicator dies and more particularly to an applicator die for use with a press to form a crimping machine for crimpingly securing terminals to the ends of leads.

Modern industry requires vast quantities of electrical leads with terminals crimpingly secured to the ends of the lead and many forms of applicator dies have been devised to perform the required crimping operation. Typically, the terminals to be crimped to the ends of the lead are provided in the form of a terminal strip comprising a plurality of serially arranged, interconnected terminals. The leads are fed individually to the die, and the die functions to crimpingly apply a terminal to the end of each lead and sever the terminal from the terminal strip in a manner to produce a continuous series of leads each having a terminal crimpingly secured the end of the lead. Whereas many applicator dies have been proposed and are currently available and whereas the various dies are generally satisfactory with respect to -performing the required crimping operation, each applicator die tends to be dedicated or limited to use in one or possibly a select few of the available crimping machines and there is no one applicator die available that is suitable for use in all of the crimping machines in current usage.

SUMMARY OF THE INVENTION

This invention is directed to the provision of an improved applicator die which is usable in virtually all currently utilized crimping machines.

More specifically, this invention is directed to the provision of an improved applicator die which has universal application to present day crimping machines irrespective of the manner in which the leads are fed to the crimping machine and irrespective of the length of the stroke of the crimping machine.

The applicator die according to the invention includes a housing defining a generally vertical slideway; means defining a generally horizontal feed path for the terminal strip; a slide mounted for reciprocal generally vertical sliding movement in the slideway; die means operative in response to sliding movement of the slide in the slideway to crimp a terminal to a lead and sever the terminal from the terminal strip; a support structure supported on the housing at a location above the feed path and extending downwardly past the feed path to a location beneath the feed path; a feed member mounted on the support structure beneath the feed path and movable when actuated to incrementally advance the terminal strip along the feed path toward the die means; and actuator means operative in response to sliding movement of the slide in the slideway to actuate the feed member. This arrangement provides a simple feeder structure for the terminal strip which allows total freedom with respect to the manner in which the leads are fed to the crimping machine.

According to a further feature of the invention, the actuator means comprise cam means. This arrangement provides a direct positive action for the feed member.

According to a further feature of the invention, the feed path defining means comprises a guide plate defining the feed path thereabove and the feed member comprises a feed finger positioned beneath the guide plate. This specific arrangement of the guide plate and feed finger clears the area above the guide plate to allow total flexibility with respect to the manner in which the leads are fed to the machine.

According to a further feature of the invention, the guide plate includes a slot extending in the direction of the feed path and the feed finger includes a pointed drive end adapted to be positioned in the slot for engagement with the underside of the terminal strip. This specific arrangement facilitates the ready engagement of the feed finger with the terminal strip to facilitate the incremental feeding of the terminal strip to the dies.

According to a further feature of the invention, the cam means providing the actuator means for the feed member includes a cam plate positioned above the feed path, a hanger structure is secured to the cam plate and extends to a location beneath the feed path, and the feed finger is pivotally mounted on the hanger structure. This arrangement provides a convenient means of positioning the feeder finger beneath the feed path.

According to a further feature of the invention, the cam means includes a cam member including a cam surface and a cam follower movable relative to the cam surface in response to sliding movement of the slide in the slideway, and the cam surface includes a first action portion coacting with the cam follower to actuate and move the feed finger upon upward movement of the slide in the slideway and a second dwell portion adjoining the action portion coacting with the cam follower to allow movement of the cam follower relative to the cam member upon further upward movement of the slide in the slideway without moving the feed finger. This specific cam arrangement allows the invention applicator die to be utilized with crimping machines having various strokes with the stroke variations being accommodated by the dwell movement of the cam follower with respect to the dwell portion of the cam surface.

DETAILED DESCRIPTION OF THE PREFERRED EMBODIMENT

Figure 1:
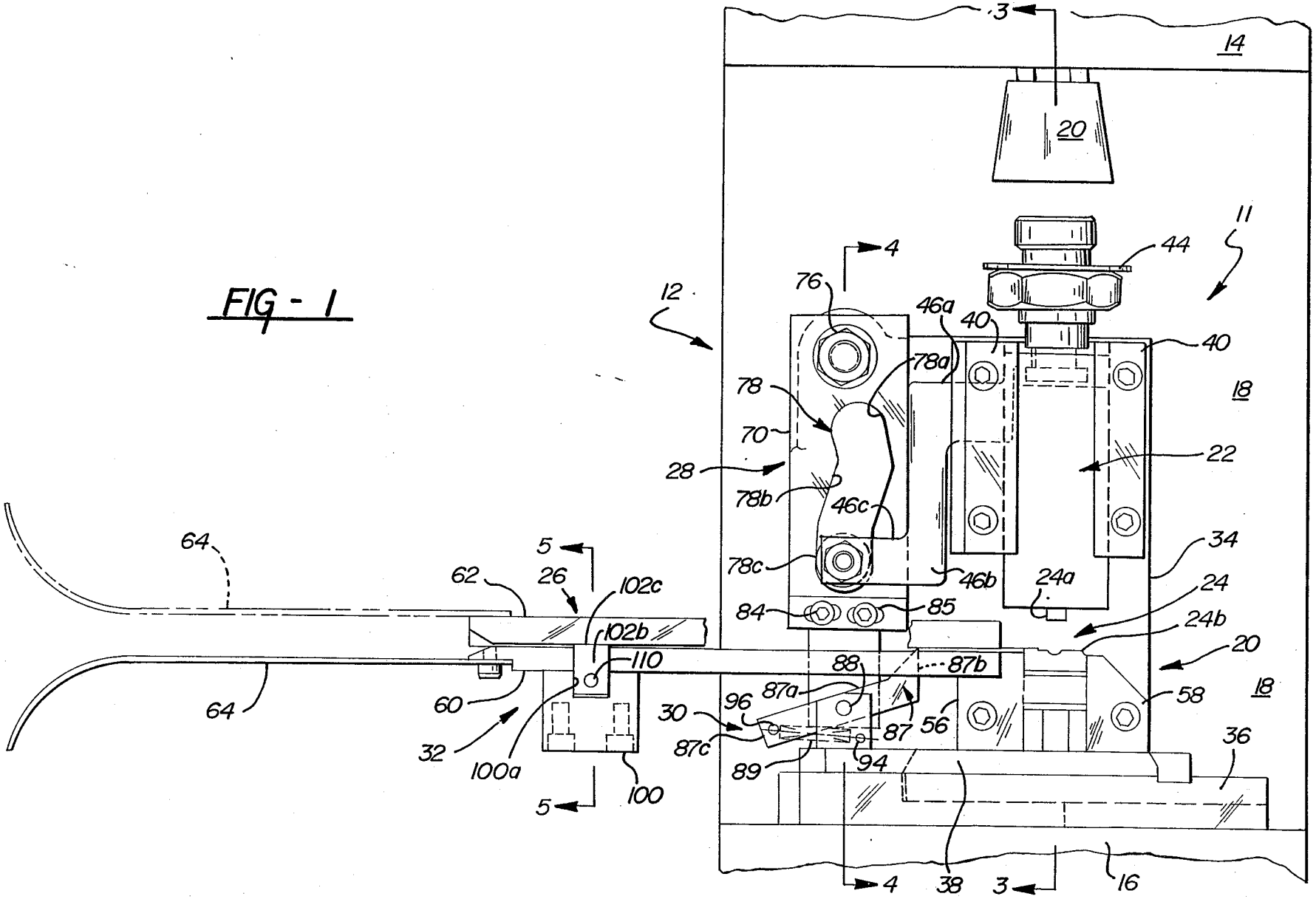
FIG. 1 is a front elevational view of a crimping machine employing the applicator die of the invention.

The invention applicator die is intended for use with a terminal strip 10 comprising a plurality of serially arranged, interconnected terminals. Strip 10 may for example be of the type seen in FIG. 7 including a carrier band 10*a* and a plurality of terminals 10*b* respectfully secured at one end thereof to successive points along the carrier band 10*a*. Carrier band 10*a* also includes a drive hole 10*c* positioned opposite each terminal 10*b* for coaction with a feed finger of the applicator die.

The invention applicator die 11 is seen in the drawings in association with a press 12 of the type including a head 14, a bed 16, a back structure 18 interconnecting the head and the bed, and a ram 20, shown schematically, mounted in known manner on the head 14 for powered reciprocal movement to provide the power for a die positioned on the bed of the press.

Applicator die 11 includes a housing or frame assembly 20, a slide 22, die means 24, a feed path assembly 26, a support structure 28, a feed finger assembly 30, and a brake assembly 32.

Housing or frame assembly 20 includes a housing member 34, a sub-plate 36, and an adaptor plate 38. Adaptor plate 38 is suitably secured to sub-plate 36 and housing 34 is suitably secured in upstanding fashion to adaptor plate 38.

Housing member 34 includes an upstanding main body portion **34*a* and a pair of spaced vertical portions 34*b* and 34*c* coacting with gibs 40 to define a rectangular vertical slideway 42. Slide 22 is sized to fit in slideway 42 so as to be freely reciprocal in slideway 42 in response to upward and downward movement of ram 20 with the applicator die positioned on the bed 16 of the press and with the slide 22 positioned in underlying relation to the ram. If required or desired, an adaptor member 44 may be secured to the upper end of the slide to facilitate engagement of the slide by the ram. An arm 46 is suitably secured to slide 22 and includes an upper portion 46*a* passing through a slot 34*d* defined in housing member portion 34*b*, a vertically extending central portion 46*b*, and a lower portion 46*c* carrying a cam follower or pin 50 secured to arm portion 46*c* by a bolt 52 and nut 54**.

Die means 24 do not form a part of the present invention and are of known form and may include punch means **24*a* carried by slide 22 coacting with anvil means 24*b* positioned between holders 56 and 58 forming a part of the housing assembly. Die means 24 function in known manner in response to downward stroking movement of slide 22 to crimp a terminal 10*b* to the exposed end 59*a* of a lead 59 and also to sever the terminal from the carrier band 10*a* of the terminal strip 10**.

Feed path assembly 26 includes a lower guide plate 60, an upper guide plate 62, and a guide bracket 64. Guide plates 60 and 62 are secured in known manner to housing assembly 20 and coact to define a feed path for the terminal strip 10 extending in a generally horizontal manner from a location outboard of the die means 24 to the die means 24 so as to incrementally feed the terminal strip 10 to the dies for the appropriate crimping and cutting action by the dies.

Figure 5:
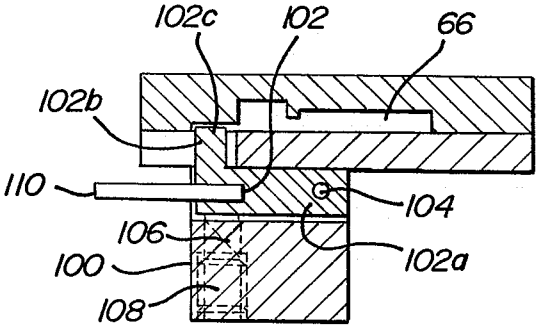
FIGS. 3, 4 and 5 are cross-sectional views taken on lines 3—3, 4—4 and 5—5 respectively of FIG. 1.
Figure 2:
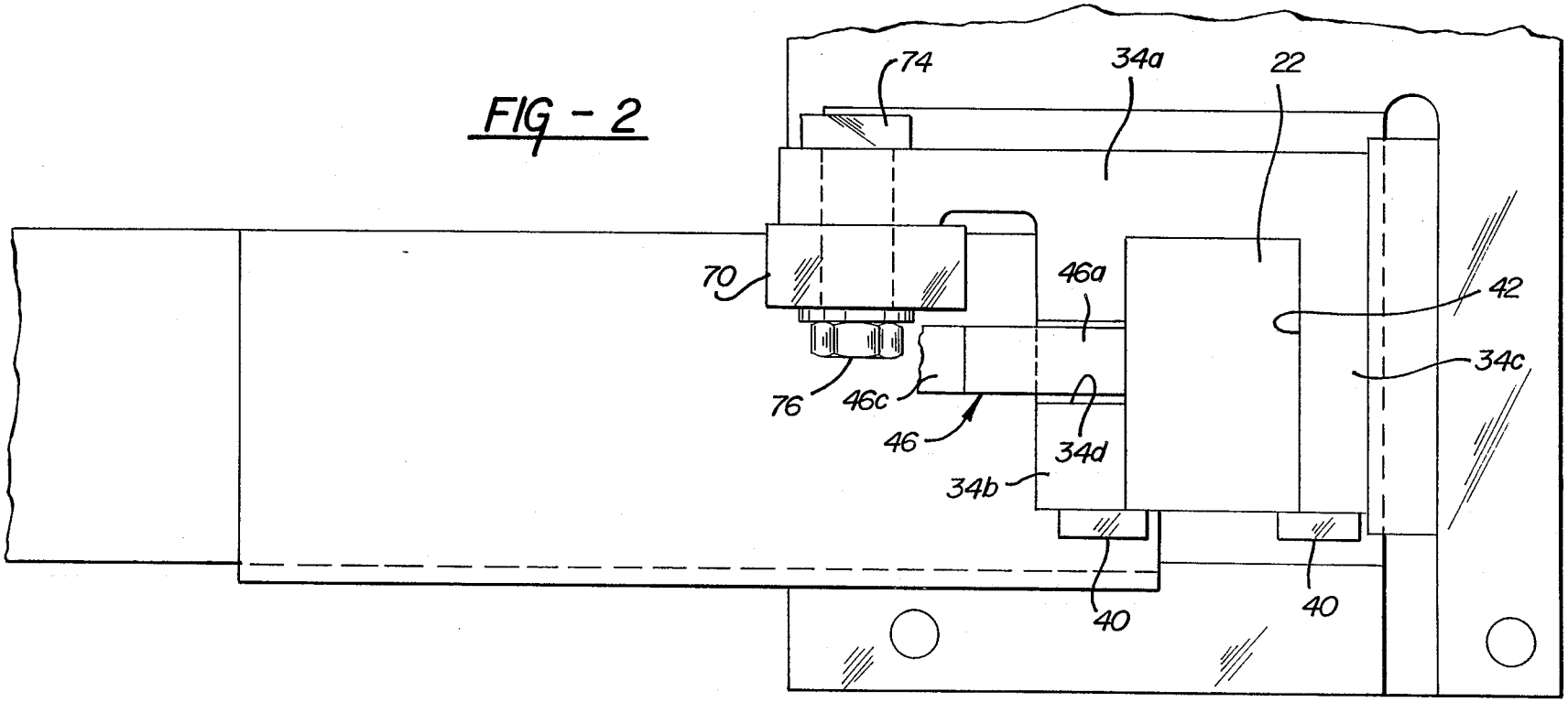
FIG. 2 is a top view of the applicator die of FIG. 1.
Figure 3:
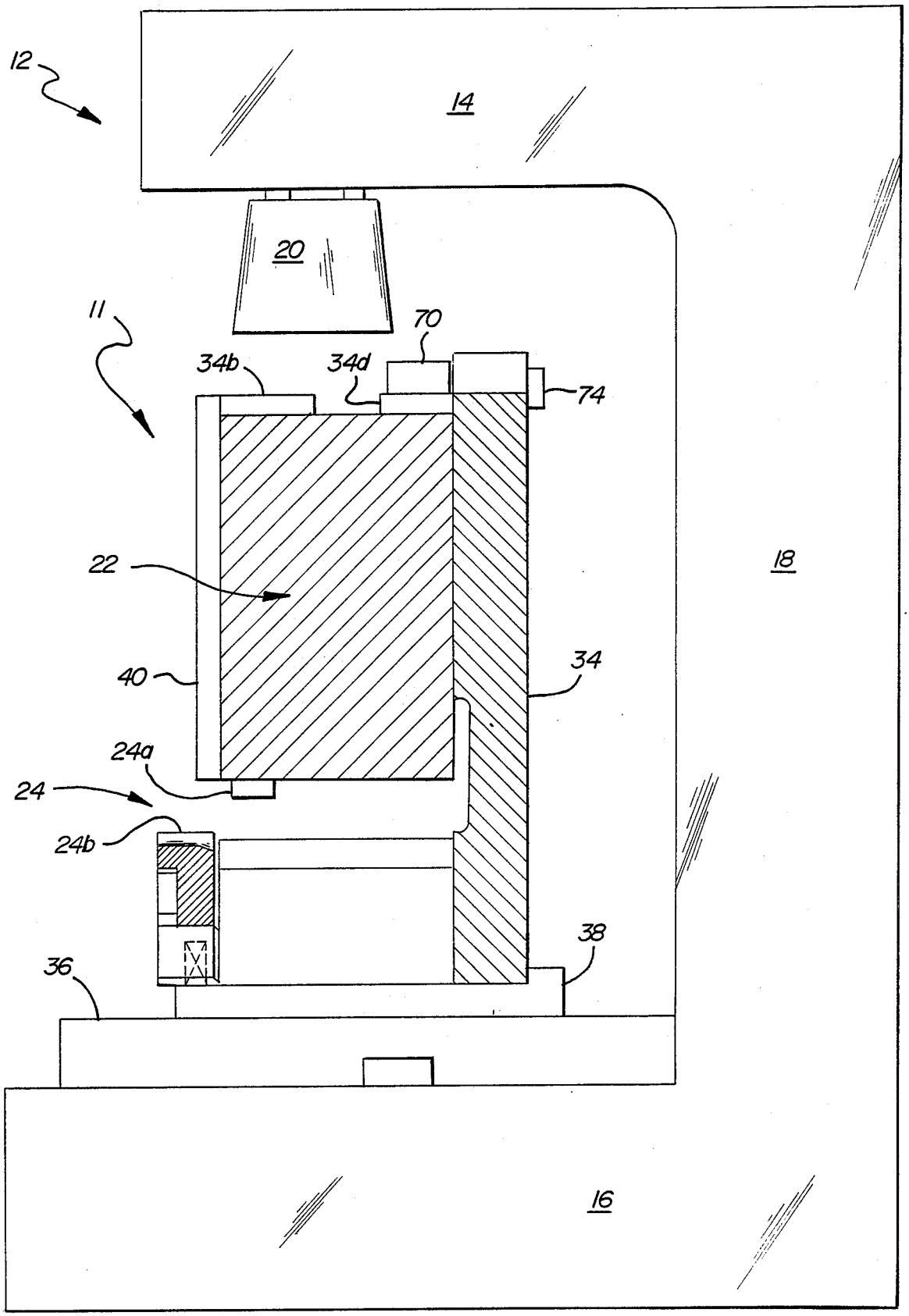
Figure 4:
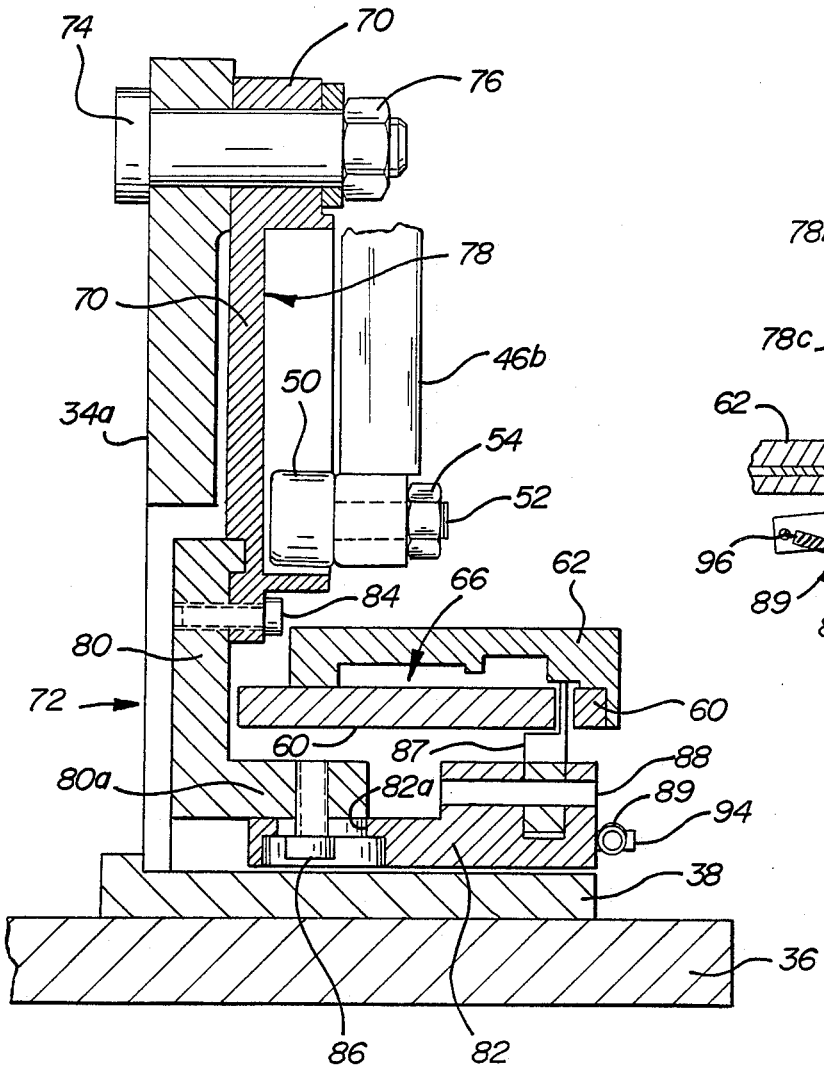
Figure 6:
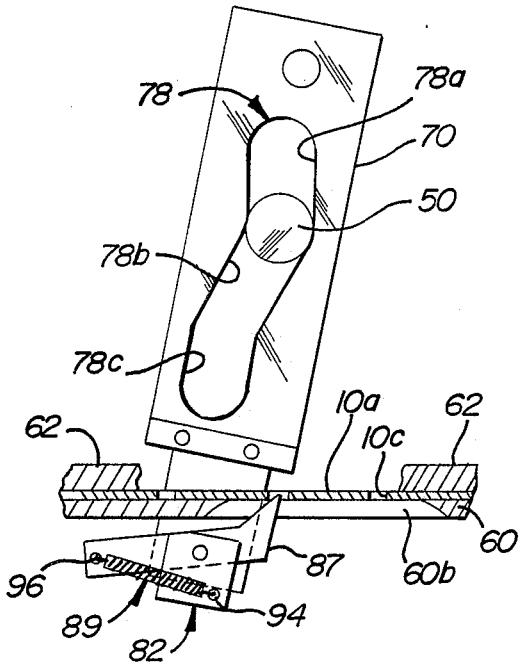
FIG. 6 is a fragmentary view of a portion of the applicator die seen in FIG. 1 showing a cam used in the die in a moved position.
Figure 9:
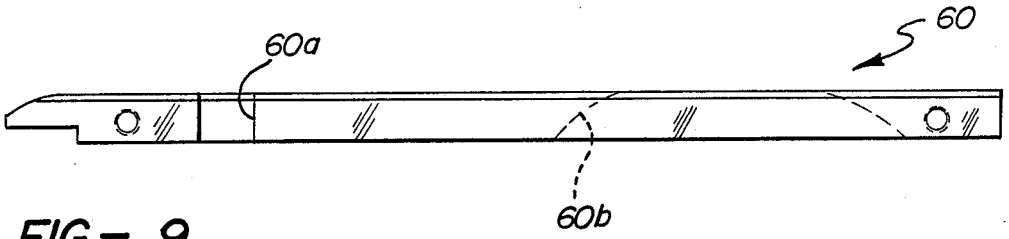
FIGS. 9 and 10 are detail views of a guide plate employed in the invention applicator die.
Figure 10:
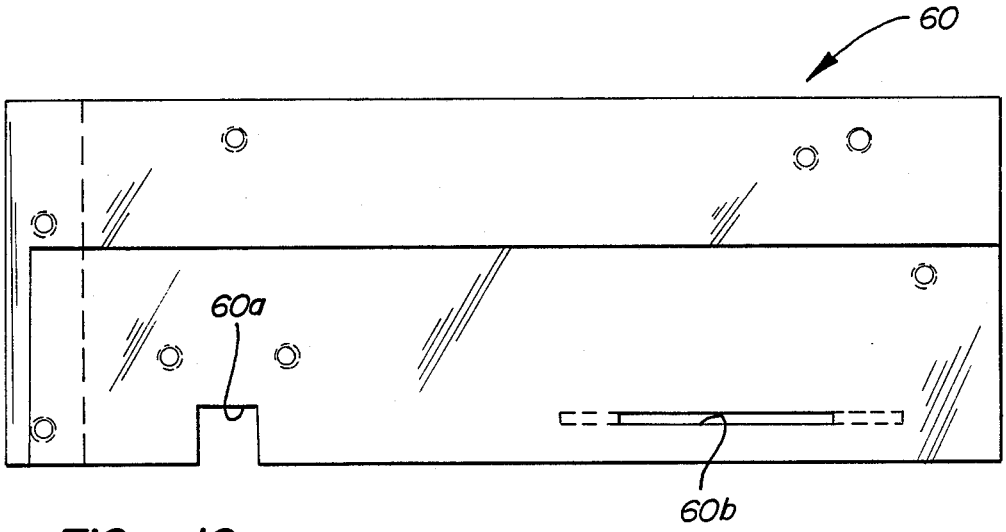

As best seen in FIGS. 4 and 5, lower guide plate 60 is of generally rectangular transverse cross section but upper guide plate 62 has a convoluted transverse cross sectional configuration to define a feed path cavity 66 between the plates configured to match and accommodate the cross-sectional configuration of terminal strip 10. Lower guide plate 60, as best seen in FIGS. 9 and 10, includes a cutout **60*a* proximate the output end of the plate and a longitudinally extending slot 60*b* proximate the inboard end of the plate. Guide bracket 64 may be secured to the outboard end of either lower plate 60 or upper plate 62 depending upon the location of the source of the terminal strip to be fed to the dies 24 via the feed path assembly 26**.

Support structure 28 includes a cam plate 70 and a hanger structure 72. Cam plate 70 has a generally rectangular configuration and is pivotally secured proximate its upper end to main body housing portion **34*a* by a pivot bolt 74 coacting with a nut 76. A cam slot or groove 78 is provided in cam plate 70 sized to receive cam pin or follower 50. Cam slot 78 includes an upper dwell portion 78*a*, an intermediate action portion 78*b*, and a lower dwell portion 78*c***.

Hanger structure 72 includes a hanger 80 and a feed finger holder 82. Hanger 80 is secured at its upper end to the lower end of cam plate 70 as by screws 84 and extends downwardly along one side edge of guide plates 60 and 62 to a location below guide plate 60 whereafter it extends laterally inwardly via a portion **80*a* to a location underneath cam plate 60 and overlying adaptor plate 38 of the housing assembly. Screws 84 are received in elongated slots 85 in the lower end of cam plate 70 so as to allow longitudinal adjustment of hanger 80** relative to the cam plate.

Feed finger holder 82 is secured to the free end of hanger portion **80*a* as by screws 86 with a slot 82*a* in holder 82 allowing significant transverse adjustment of the holder relative to the hanger. Holder 82 further includes a mounting portion 82*b* defining a groove or slot 82*c***.

Feed finger assembly 30 includes a feed finger 87, a pivot pin 88, and a coil spring 89. Feed finger 87 is in the form of a lever and includes a main body portion **87*a* and a reduced thickness pointed front end drive portion 87*b* sized to be positioned in slot 60*b* of guide plate 60. Finger 87 is pivotally mounted intermediate its ends to holder 82 by pivot pin 88 and is maintained in a constantly upwardly biased disposition by coil spring 89 which extends between a pin 94 carried by holder 82 and a pin 96 carried on the remote or trailing end 87*c*** of the feed finger.

Brake assembly 32 includes a brake holder 100 and a brake lever 102. Holder 100 is suitably secured to the underface of lower guide plate 60 outboard of feed finger assembly 30 and proximate the entry end of the feed path defined by the plates 60, 62 and defines an upwardly opening U-shaped groove or slot **100*a* extending transversely with respect to the terminal strip feed path. Brake lever 102 includes a horizontal leg portion 102*a* positioned in slot 100*a* and a vertical leg portion 102*b* positioned in the cutout 60*a* in lower guide plate 60. Lever 102 is pivotally mounted relative to holder 100 by a pin 104 carried by the holder so that the brake lever 102 may pivot about the axis defined by pin 104 to bring the upper face 102*c* of leg 102*b* into and out of engagement with the underface of the carrier band 10*a* of the terminal strip 10** being fed along the guide feed path.

Brake lever 102 is constantly urged into braking coaction with the carrier band of the terminal strip by a coil spring 106 positioned in a bore in the holder 100 with the biasing force of the spring 106 being adjustable by selective adjustment of a set screw 108. A handle 110 secured to lever 102 allows the brake lever to be moved downwardly when desired against the resistance of spring 106 to allow feeding of a terminal strip along the feed path. Brake lever 102 is dimensioned and configured such that the upper face **102*c* of the vertical leg 102*b* assumes a precisely horizontal disposition as the lever contacts the underface of the carrier band of the terminal strip so as to maximize the frictional braking interaction as between the brake lever and the terminal strip. The upward pivotal movement of the brake lever 102 under the influence of spring 106 is limited by the engagement of the upper face of leg portion 102 with the adjacent underface 60c of lower guide plate 60 so as to prevent upward distortion or deformation of carrier band 10a by excessive braking force exerted by spring 106**.

Figure 7:
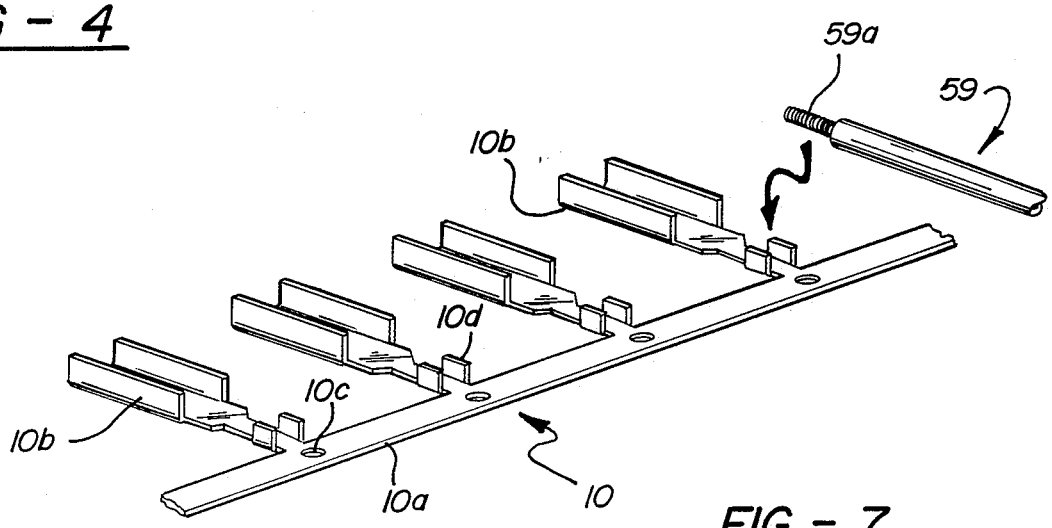
FIG. 7 is a fragmentary perspective view of a terminal strip shown in association with a lead.
Figure 8:
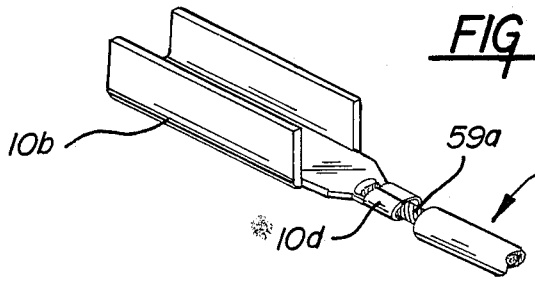
FIG. 8 is a fragmentary perspective view of a lead with a terminal crimpingly secured thereto.

As illustrated schematically in FIG. 7, applicator die 11 functions as the terminal strip 10 is fed into the die means 24 to selectively crimp portions 10d of each terminal 10b around the stripped back bare wire portion 59a of a lead 59, whereafter the terminal is severed from the carrier band 10a to form the lead and terminal combination as seen in FIG. 9.

Terminal strip 10 is typically provided in reel form and is fed along bracket 64 into the space 66 defined between plates 60, 62 and along the feed path defined between the plates to the dies 24. In operation, brake lever 102 exerts a constant frictional braking action on the underside of carrier band 10a as the terminal strip is fed incrementally by the feed finger 87 in response to reciprocating movement of slide 22.

Specifically, with pointed end 87b of feed finger 87 positioned in a drive hole 10c in terminal strip 10, as the slide 22 begins a downward stroke to initiate a crimping and cutting action by the dies 24, cam pin 50 coacts with cam slot 78 to drive feed finger 87 forwardly and advance a new terminal 10b into precise alignment with dies 24 so as to enable the terminal portions 10d to be crimped over the bare lead portion 59a of a lead 59 as the lead is simultaneously fed to the coacting dies.

The actual forward movement of the feed finger occurs as the cam pin 50 traverses the action portion 78b of the cam slot with no forward movement of the feed finger occurring as the cam pin continues downwardly into the dwell portion 78c of the cam slot as the slide completes its downward movement. As the slide completes its downward movement, dies 24 coact in known manner to crimp the portions 10d of the terminal over the bare lead 59a and sever the terminal from the carrier band 10a , and strippers act in known manner to eject the lead and terminal combination from the dies.

Figure 11:
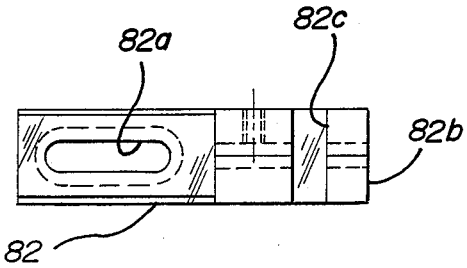
FIGS. 11 and 12 are detailed views of a feed finger holder employed in the invention applicator die.
Figure 12:
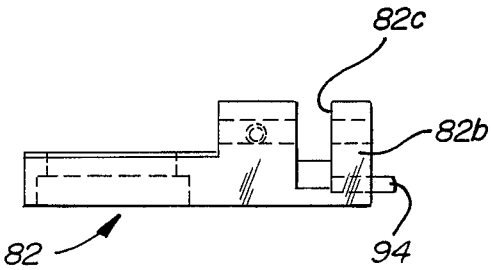

As the slide begins to move upwardly on its return stroke, cam pin 50 initially moves upwardly in dwell portion 78c of the cam slot so that no movement of the feed finger occurs during this initial fraction of the upward movement of the slide whereafter, as the cam pin 50 moves onto the action portion 78b of the slot, finger 87 is biased downwardly against the urging of spring 89 out of engagement with the engaged drive hole 1Oc and dragged rearwardly or to the left as seen in FIG. 11 along the underface of the carrier band 10a toward a new drive hole 10c. As the cam pin completes its movement along the action portion 78b of the cam slot, the pointed end 87b of feed finger 87 arrives at a new drive hole 10c into which it is urged by the biasing of spring 89. Depending upon the stroke of the particular crimping apparatus with which the invention applicator die used, the upward movement of the slide may cease at such time as cam pin 50 has completed its upward movement along the action portion 78b of the cam slot or, in the case of a machine having a relatively longer stroke, the cam pin may continue upwardly in dwell portion 78a of the cam slot but this further upward movement has no effect on the feed finger 89 which remains with its pointed drive front end in engagement with the drive hole 10c preparatory to the next downward driving movement of the slide to move the terminal strip incrementally forwardly and move another terminal 10b into position proximate the dies 24 for a further crimping action with respect to a new lead 59 and a further severing action with respect to the carrier band 10a.

The manner in which the leads 59 are fed into the coacting dies 24 does not form a part of the present invention. However, the present invention, by disposing the feed finger 87 beneath the terminal feed path, allows a total choice as between the available methods of feeding the leads to the machine and, in particular, allows the leads to be fed from the left as viewed in FIG. 1 above the guide plates 60, 62 to the coacting dies if such a feed path is desired. Other possible lead feed paths include a path accessing dies 24 from the right as viewed in FIG. 1 or various other lead feed paths accessing the dies 24 from above or below the machine. As noted, the present invention allows total freedom of choice as between the various available lead feed paths so that the invention applicator die may be used with any crimping machine irrespective of the lead feed path employed by the crimping machine.

The present invention also allows the invention applicator die to be utilized with crimping machines or presses having varying stroke lengths with the variations in stroke lengths being accommodated by the dwell portion 78a at the top of cam slot 78. That is, for presses having a relatively short stroke, the cam pin 50 completes its upward movement at the upper end of the action portion 78b of the cam slot but for presses having longer strokes the cam pin continues upwardly into the dwell portion 78a for a distance sufficient to accommodate the additional stroke length.

The invention applicator die also provides steady and effective braking of the terminal band with the brake lever 102 arranged to at all times apply a uniform smooth braking action to the underside of carrier band 10a by virtue of the parallel disposition of the upper face 102c of lever 102 with respect to the underface of the carrier band to maximize the frictional engagement between the brake member and the carrier band and to provide a smooth, uniform braking action. The magnitude of the braking action may be readily adjusted by a simple adjustment of set screw 108 to vary the bias exerted by spring 106 and excessive upward braking force against the carrier band is prevented by engagement of the upper face of lever portion 102a with the lower face 60c of the lower guide plate 60. The invention brake assembly 32 also allows an absolutely identical brake assembly to be used for both the illustrated left side terminal strip feed path as well as for a right side terminal strip feed path.

The invention applicator die also allows ready adjustment of the feeder mechanism to accommodate various presses, various crimping applications, and various terminal strips. Specifically, finger 87 may be moved longitudinally relative to the cam plate 70 by virtue of screws 84 operating in elongated slots 85, and finger 87 may be moved transversely or laterally relative to the cam plate by adjusting movement of screw 86 in slot 82a.

It will further be seen that although the invention applicator die has been illustrated as operating in a post-feed manner, that is operating to advance the terminal strip as the slide 22 moves downwardly, the invention applicator die may be readily adjusted to provide pre-feeding, that is feeding of the terminal strip as the slide 22 is moved upwardly.

The invention applicator die will be seen to have universal application to all currently utilized crimping machines since it is compatible with any method of feeding the leads to the dies and is compatible with any of the various strokes currently employed by the currently utilized crimping machines.

Whenever the directions vertical, horizontal, above, or below are specified in the appended claims, it will be understood that these terms are limiting only in the sense of requiring a particular relative disposition as between the specified directions.

Whereas a preferred embodiment of the invention has been illustrated and described in detail, it will be apparent that various changes may be made in the disclosed embodiment without departing from the scope or spirit of the invention.

We claim:

1. An applicator die for use with a crimping machine of the type in which a supply of terminals is fed to the machine in the form of a terminal strip comprising a plurality of serially arranged, interconnected terminals, individual leads are fed to the machine, and the machine functions to crimpingly apply a terminal to an end of each lead and sever the terminal from the terminal strip in a manner to produce a series of leads each having a terminal crimpingly secured to an end thereof, said applicator die including:

(A) a housing defining a generally vertical slideway;

(B) means defining a generally horizontal feed path for the terminal strip;

(C) a slide mounted above said feed path for reciprocal generally vertical sliding movement in said slideway;

(D) die means operative in response to sliding movement of said slide in said slideway to crimp a terminal to a lead and sever the terminal from the terminal strip;

(E) a support structure supported on said housing at a location above said path and extending downwardly past said path to a location beneath said path;

(F) a feed member mounted on said support structure underneath said path and movable when actuated to incrementally advance the terminal strip along said feed path toward said die means; and (G) actuator means operative in response to sliding movement of said slide in said slideway to actuate said feed member.

2. An applicator die according to claim 1 wherein:

(H) said actuator means are operative in response to downward movement of said slide to actuate said feeder means.

3. An applicator die according to claim 1 wherein:

(H) said actuator means comprise cam means.

4. An applicator die according to claim 3 wherein:

(I) said support structure is pivotally mounted proximate its upper end on said housing; and (J) said feed member comprises a feed finger pivotally mounted on the lower end of said support structure beneath said feed path.

5. An applicator die according to claim 4 wherein:

(K) said support structure includes a cam plate positioned above said feed path and a hanger structure secured to said cam plate and extending downwardly to a location beneath said feed path;

(L) said feed finger is pivotally mounted on said hanger structure; and (M) said actuator means comprises a cam surface defined on said cam plate and a cam pin carried by said slide and coacting with said cam surface.

6. An applicator die according to claim 5 wherein:

(O) said feed path defining means comprises a guide plate defining said feed path thereabove and including a longitudinally extending slot;

(P) said hanger structure extends from said cam plate downwardly to a location below said guide plate and thence laterally to a location underneath said guide plate; and (Q) said feed finger is pivotally mounted on said hanger structure underneath said slot with one end of said finger positioned in said slot for engagement with the terminal strip.

7. An applicator die according to claim 6 wherein:

(Q) said applicator die further includes a spring biasing said feed finger to urge said one end of said finger upwardly into engagement with the terminal strip.

8. An applicator die according to claim 5 wherein:

(N) said cam surface includes a first action portion coacting with said cam pin to actuate and move said feed member upon upward movement of said slide in said slideway and a second dwell portion adjoining said action portion coacting with said cam pin to allow movement of said cam pin relative to said cam plate upon further upward movement of said slide in said slideway without moving said feed member.

9. An applicator die according to claim 1 wherein:

(H) said feed path defining means comprises a plate defining said feed path thereabove; and (I) said feed member comprises a feed finger positioned underneath said plate.

10. An applicator die according to claim 9 wherein:

(J) said plate includes a slot extending in the direction of said path; and (K) said feed finger includes a pointed drive end adapted to be positioned in said slot for driving engagement with the terminal strip.

11. An applicator die according to claim 10 wherein the terminal strip includes a plurality of longitudinally spaced drive holes; and (L) said pointed drive end of said feed finger is arranged to enter the holes on the strip to incrementally advance the strip.

12. An applicator die according to claim 11 wherein:

(M) said feed finger is pivotally mounted on said support structure; and (N) said applicator die includes means biasing said feed finger in a direction to constantly urge said pointed drive end upwardly against the under side of the terminal strip.

13. An applicator die for crimping terminals carried by a terminal strip to leads comprising:

(A) a housing defining a vertical slideway;

(B) a slide mounted for reciprocal vertical movement in said slideway;

(C) die means operative in response to vertical movement of said slide in said slideway to crimp a terminal to a lead and sever the terminal from the terminal strip;

(D) a guide plate defining a generally horizontal feed path for the terminal strip and including a longitudinally extending guide slot;

(E) a cam plate pivotally secured to said housing in a position over said feed path and defining a cam slot;

(F) a hanger structure secured to the lower end of said cam plate and extending downwardly to a location below said guide plate;

(G) a feed finger pivotally mounted on the lower end of said hanger structure underneath said guide plate and including a pointed drive end extending upwardly into said guide slot for engagement with the terminal strip; and (H) a cam pin, carried by said slide, positioned in said cam slot and coacting with said cam slot in response to vertical movement of said slide in said slideway to move said feed finger in a sense to incrementally advance the terminal strip along said feed path toward said die means.

14. An applicator die according to claim 13 and further including:

(I) a brake member positioned beneath said guide plate and including a braking surface arranged to frictionally engage the underside of the terminal strip.

15. An applicator die according to claim 14 wherein:

(J) said brake member comprises a lever including a horizontal leg portion positioned beneath said guide plate and a vertical leg portion extending upwardly through an opening in said guide plate; and (K) said braking surface is defined on the free upper end of said vertical leg portion.

16. An applicator die for use with a crimping machine of the type in which a supply of terminals is fed to the machine in the form of a terminal strip comprising a plurality of serially arranged, interconnected terminals, individual leads are fed to the machine, and the machine functions to crimpingly apply a terminal to an end of each lead and sever the terminal from the terminal strip in a manner to produce a series of leads each having a terminal crimpingly secured to an end thereof, said applicator die including:

(A) a housing defining a generally vertical slideway;

(B) a guide plate defining thereabove a generally horizontal feed path for the terminal strip;

(C) a slide mounted above said feed path for reciprocal generally vertical sliding movement in said slideway;

(D) die means operative in response to sliding movement of said slide in said slideway to crimp a terminal to a lead and sever the terminal from the terminal strip;

(E) feed means operative to incrementally advance the terminal strip along said feed path toward said die means; and (F) a brake assembly positioned beneath said feed path and including a lever mounted for pivotal movement about an axis generally parallel to said feed path and including a horizontal leg portion positioned beneath said guide plate and a vertical leg portion extending upwardly from one end of said horizontal leg portion through an opening in said guide plate, said lever being spring biased upwardly to bring a braking surface defined on the free upper end of said vertical leg portion into frictional engagement with the undersurface of the terminal strip.

17. An applicator die according to claim 16 wherein:

(G) said pivotal axis is proximate the other end of said horizontal leg portion; and (H) said spring biasing is provided by a spring positioned beneath said one end of said horizontal leg portion.

18. An applicator die according to claim 17 wherein:

(I) said brake assembly further includes a brake holder defining a transverse slot for receipt of said horizontal leg portion and a set screw received in a threaded bore in said holder beneath said spring and operative in response to selective turning of said set screw to vary the spring biasing provided by said spring.

* * * * *